US010774603B2

(12) United States Patent
Glaser et al.

(10) Patent No.: US 10,774,603 B2
(45) Date of Patent: Sep. 15, 2020

(54) HOOKLESS HANGER FOR A MULTILATERAL WELLBORE

(71) Applicant: Halliburton Energy Services, Inc., Houston, TX (US)

(72) Inventors: Mark C. Glaser, Houston, TX (US); Michael Linley Fripp, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/318,481

(22) PCT Filed: Sep. 15, 2016

(86) PCT No.: PCT/US2016/051901
§ 371 (c)(1),
(2) Date: Jan. 17, 2019

(87) PCT Pub. No.: WO2018/052423
PCT Pub. Date: Mar. 22, 2018

(65) Prior Publication Data

US 2019/0234163 A1 Aug. 1, 2019

(51) Int. Cl.
*E21B 23/12* (2006.01)
*E21B 23/01* (2006.01)
(Continued)

(52) U.S. Cl.
CPC ..... *E21B 23/01* (2013.01); *E21B 23/12* (2020.05); *E21B 33/13* (2013.01); *E21B 41/0035* (2013.01); *E21B 43/10* (2013.01)

(58) Field of Classification Search
CPC ..... E21B 41/0035; E21B 23/002; E21B 43/10
See application file for complete search history.

(56) References Cited

U.S. PATENT DOCUMENTS 2,268,514 A * 12/1941 Oberwetter ..... E21B 49/06 175/79
4,074,762 A * 2/1978 Parker ..... E21B 23/03 166/117.5

(Continued)

FOREIGN PATENT DOCUMENTS

CA 2904470 11/2018
RU 2553705 6/2015

(Continued)

OTHER PUBLICATIONS

International Patent Application No. PCT/US2016/051901 , "International Search Report and Written Opinion", dated May 25, 2017, 16 pages.

(Continued)

*Primary Examiner* — Giovanna Wright
(74) *Attorney, Agent, or Firm* — Kilpatrick Townsend & Stockton LLP

(57) ABSTRACT

A hookless hanger for a multilateral wellbore can include an assembly with an upper tubular body and a lower tubular body. The upper tubular body can be positioned in a main bore of the wellbore. The lower tubular body can be pivotally coupled to the upper tubular body at a joint. The lower tubular body can pivot relative to the upper tubular body and can be positioned in a lateral bore of the wellbore.

18 Claims, 8 Drawing Sheets

(51) Int. Cl.

| | |
|---|---|
| ***E21B 33/13*** | (2006.01) |
| ***E21B 43/10*** | (2006.01) |
| ***E21B 41/00*** | (2006.01) |

(56) References Cited

U.S. PATENT DOCUMENTS

| | | | | |
|---|---|---|---|---|
| 5,415,238 | A | 5/1995 | Nice et al. | |
| 5,458,209 | A | 10/1995 | Hayes et al. | |
| 5,477,925 | A | 12/1995 | Trahan et al. | |
| 5,826,651 | A | 10/1998 | Lee et al. | |
| 6,244,339 | B1 | 6/2001 | Buytaert et al. | |
| 6,619,400 | B2 | 9/2003 | Brunet | |
| 6,732,802 | B2 | 5/2004 | Smith et al. | |
| 7,726,406 | B2 | 6/2010 | Xu et al. | |
| 8,590,608 | B2 | 11/2013 | Linn et al. | |
| 8,950,504 | B2 | 2/2015 | Bennett et al. | |
| 2002/0108754 | A1* | 8/2002 | Hess | E21B 41/0035 166/313 |
| 2013/0126165 | A1* | 5/2013 | Themig | E21B 41/0035 166/285 |
| 2014/0083689 | A1* | 3/2014 | Streich | E21B 34/063 166/250.15 |
| 2014/0102716 | A1* | 4/2014 | Benson | E21B 43/08 166/381 |
| 2014/0166366 | A1 | 6/2014 | Utter et al. | |
| 2015/0376955 | A1 | 12/2015 | Wolf et al. | |

FOREIGN PATENT DOCUMENTS

| | | |
|---|---|---|
| RU | 2575197 | 2/2016 |
| RU | 2576413 | 3/2016 |
| RU | 2588999 | 7/2016 |
| WO | 2012012884 | 2/2012 |
| WO | 2015163902 | 10/2015 |
| WO | 2015187297 | 12/2015 |
| WO | 2016108815 | 7/2016 |

OTHER PUBLICATIONS

CA3,029,797 , "Office Action", dated Feb. 18, 2020, 3 pages.
CA3,029,797 , "Office Action", dated Nov. 15, 2019, 6 pages.
GC2017/33769 , "Notice of Allowance", dated Jun. 30, 2019, 3 pages.
GC2017/33769 , "Office Action", dated Feb. 12, 2019, 5 pages.
RU2019103899 , "Office Action", dated Feb. 11, 2020, 6 pages.
RU2019103899 , "Office Action", dated Sep. 26, 2019, 8 pages.

* cited by examiner

HOOKLESS HANGER FOR A MULTILATERAL WELLBORE

TECHNICAL FIELD

The present disclosure relates generally to accessing lateral bores in a wellbore, and more particularly (although not necessarily exclusively), to a hookless hanger for a multilateral wellbore.

BACKGROUND

A well system, such as an oil or gas well for extracting hydrocarbon fluids from a subterranean formation, can include a multilateral wellbore. A liner assembly can be positioned in the wellbore to extend from a main bore into a lateral bore using a whipstock. The whipstock can be removed from the wellbore and cement can be used to secure the liner assembly to the wellbore. The portion of the assembly in the main bore can be drilled or washed out. A whipstock or a deflector can be positioned in the wellbore to guide tools through an inner area of the portion of the remaining liner assembly cemented at a location in the lateral bore.

DETAILED DESCRIPTION

Figure 1:
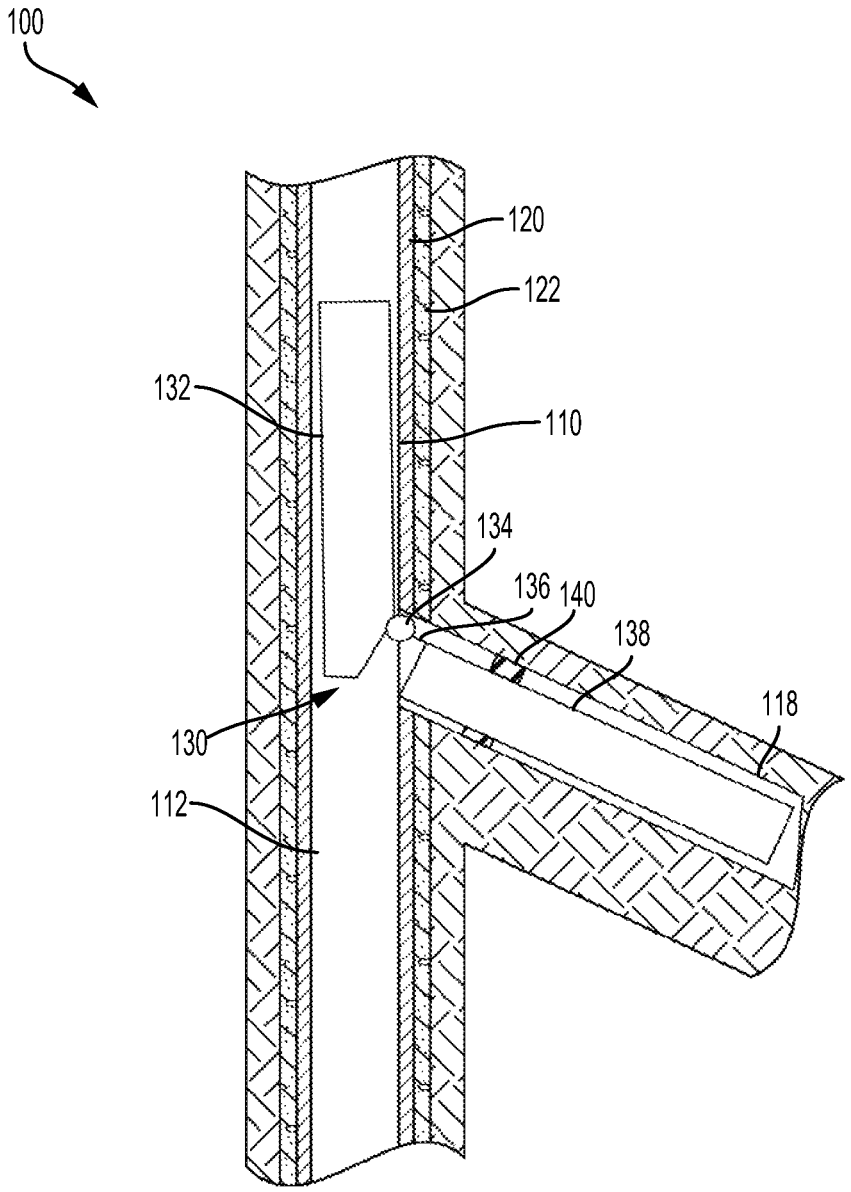
FIG. 1 is a cross-sectional diagram of a multilateral wellbore with a hookless hanger assembly according to one aspect of the present disclosure.

Certain aspects and features relate to a liner assembly that can be retained at a junction in a multilateral wellbore due to a pivotable connection between an upper tubular body and a lower tubular body of the liner assembly. The upper tubular body can be positioned in a main bore of the multilateral wellbore. The lower tubular body can be pivotally coupled to the upper tubular body at a joint so that the lower tubular body can pivot relative to the upper tubular body and be positioned in a lateral bore of the multilateral wellbore. The upper tubular body is unable to pivot into the lateral bore and can retain the liner assembly at the junction. A deflector can be coupled to an inner surface of the upper tubular body to guide tools into the lower tubular body and the lateral bore.

The liner assembly can be positioned in the wellbore using a running tool. The joint and the upper tubular body can remain in the main bore and provide a stopping mechanism for the liner assembly. The lower tubular body can include (or be coupled to) a packer to create a seal between the main bore and the lateral bore to prevent material passing between the outer surface of the lower tubular body and the inner surface of the lateral bore. In some aspects, cement can be positioned radially around the lower tubular body to retain the lower tubular body in the lateral bore and to create a seal between the main bore and the lateral bore. The deflector can be flexible so that the running tool can be removed by compressing the deflector towards the inner surface of the wellbore.

In some aspects, the joint (e.g., a hinge pin) between the upper tubular body and the lower tubular body can be dissolved to separate the upper tubular body from the lower tubular body. In some aspects, the joint can be made of a metal (e.g., an aluminum alloy or a magnesium alloy) or a plastic (e.g., polyglycolic acid ("PGA"), polyactic acid ("PLA"), thiol, acrylate, acrylic rubber, polycaprolactone (PCL), polyhydroxyalkonate, and thermoplastic polyurethane ("TPU")) that dissolves in response to exposure to a specific liquid. In some aspects, the joint can be made of an aliphatic polyester in which the hydrolysable ester bond on the aliphatic polyester can make the material degrade in water. A dissolvable metal alloy (e.g., magnesium or aluminum alloy) may further comprise an amount of dopant material that can increase the galvanic reaction or decrease the growth of protective passivation on the metal alloy. Suitable dopants can include but are not limited to copper, carbon, gallium, tungsten, nickel, iron, copper, indium, zinc, calcium, and tin. The concentration of the dopant can be in an amount from about 0.05% to 25% by weight of the dissolvable metal alloy. The dissolvable metal can be wrought, cast, forged, and/or extruded. The metal can be formed as a solid solution process or as a nano-structured matrix. In some examples, the dissolvable material can be coated with a protective layer to delay the onset of the corrosion. The coating can inhibit the onset of corrosion until the coating is compromised either by mechanically removing the coating, by chemically removing the coating, or by the porosity of the coating allowing degradation of the dissolvable material. The joint can dissolve in response to the acidity of the fluid, the temperature of the fluid, or the chemical composition of the fluid. In some aspects, the joint can dissolve in response to contact with an acid introduced into the wellbore. In additional or alternative aspects, the joint can be made of a degradable alloy that dissolves in response to contact with water, brine, or another fluid naturally present during the life of the wellbore. In some aspects, the liner assembly can enable fracking in the lateral bore. Well fluid from the lateral can flow through the liner assembly from the lower tubular body to the upper tubular body and the well fluids can cause the joint to dissolve. The acid used in the wellbore cleanup or acid stimulation can accelerate the joint dissolving. The upper tubular body can be removed using a spear or other retrieval device coupled to drill pipe or coiled tubing.

A hookless hanger can provide a multilateral junction (e.g., a Technology Advancement of MultiLaterals ("TAML") level 3 or level 4 multilateral junction) for a multilateral wellbore. A hookless hanger can reduce the number of runs needed to complete and perform an operation (e.g., fracking) a lateral bore in a multilateral wellbore.

Also, some runs can be performed with coiled tubing rather than drill pipe. A hookless hanger can provide an upper tubular body to form a junction at a casing window. A hookless hanger can also include an integrated deflector for guiding tools or tubing string into the lower tubular body in the lateral bore. A hookless hanger can also have a joint that can dissolve so that the upper tubular body can be removed separate from the lower tubular body to provide an unobstructed main bore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional diagram of an example of a well system 100 with a liner assembly 130. The well system 100 can include a wellbore 110 with a main bore 112 and a lateral bore 118. The main bore 112 can include a casing string 120 and a cement casing 122. The liner assembly 130 can include an upper tubular body 132 and a lower tubular body 136 pivotally coupled by a hinge pin 134.

The liner assembly 130 can be positioned at a junction in the wellbore 110 between the main bore 112 and the lateral bore 118. The lower tubular body 136 can pivot relative to the upper tubular body 132 such that the lower tubular body 136 can be positioned in the lateral bore 118 and the upper tubular body 132 can be positioned in the main bore 112. The upper tubular body 132 and hinge pin 134 can form a stop, to prevent the liner assembly 130 from moving farther into the wellbore 110. The lower tubular body 136 can be shaped based on an opening between the main bore 112 and the lateral bore 118. In some aspects, an end of the lower tubular body 136 closest to the main bore 112 is angled such that the end of the lower tubular body 136 is flush with the opening. In additional or alternative aspects, an outer surface of the lower tubular body 136 can include a packer 140 for sealing with the inner surface of the lateral bore 118. In additional or alternative aspects, cement can be positioned around the outer surface of the lower tubular body 136 to create a seal with the inner surface of the lateral bore 118.

In some aspects, a running tool can be coupled to the liner assembly 130 for positioning the lower tubular body 136 into the lateral bore 118. The running tool can be detached from the liner assembly 130 and removed from the wellbore 110. In some aspects, the upper tubular body 132 can have a deflector such that a tool can be inserted into the liner assembly 130 and be guided into the lateral bore 118. For example, a bow spring or a spring-loaded ramp can be coupled to an inner surface of the upper tubular body 132 such that a junction isolation tool can be guided into the lateral bore 118. In additional or alternative aspects, the deflector can be flexible such that tools can be removed from the liner assembly 130.

In some aspects, the hinge pin 134 can be dissolved to separate the upper tubular body 132 from the lower tubular body 136. In some examples, a pivotable connection created by the hinge pin 134 can be created with parts that slideably rotate about an axis. The pivotable connection can also represent a self-locking hinge. In additional or alternative examples, the hinge pin 134 can bend with a flexure. In some aspects, the hinge pin 134 can be made of a material that dissolves in response to exposure to a specific liquid introduced to the wellbore. In additional or alternative aspects, the hinge pin 134 can dissolve in response to contact with fluid naturally present during the installation, completion, stimulation, or production of the wellbore. In some aspects, the liner assembly 130 can enable fracking in the lateral bore 118. Well fluid from the lateral can flow through the liner assembly 130 from the lower tubular body 136 to the upper tubular body 132. The well fluids can dissolve the hinge pin 134. In some aspects, dissolving can include disintegrating, degrading, decomposing, or eroding. In additional or alternative aspects, dissolving can include that the material structurally weakens to the point of losing structural integrity. Dissolving can include any means of degradation including, but not limited to, galvanic degradation, hydrolytic degradation, corrosion, electrochemical degradation, thermal degradation, or combinations thereof. In some examples, dissolving can include complete degradation, in which no solid end products remain after dissolving. In some aspects, the degradation of the material may be sufficient for the mechanical properties of the material to be reduced to a point that the material no longer maintains its integrity. The upper tubular body 132 can be removed separate from the lower tubular body 136 using a retrieval device. In additional or alternative aspects, the upper tubular body 132 can be made of a dissolvable material and dissolve due to exposure to specific fluids.

In some aspects, a wellbore can have more than one lateral bore and a liner assembly can be positioned in any number of the lateral bores. In some aspects, a liner assembly can be positioned in an open-hole wellbore. In some aspects, the liner assembly 130 can form a junction between a lateral bore and another bore extending from the lateral bore. Although the liner assembly 130 is described as having an upper tubular body 132 and a lower tubular body 136, the component of a liner assembly can have any shape. For example, a liner assembly can have an upper oval body and a lower oval body, each with a passage therethrough.

FIGS. 2-6 depict a well system 200 with a liner assembly 230. The well system 200 can include a multilateral wellbore with a main bore 212 and a lateral bore 218. The liner assembly can include an upper tubular body 232, a lower tubular body 236, a hinge pin 234, a liner string 238, and a bow spring 240. The lower tubular body 236 can be pivotally coupled to the upper tubular body by the hinge pin 234. The liner string 238 can extend from the lower tubular body 236. The bow spring 240 can be coupled to an inner surface of the upper tubular body 232. The liner assembly can further include a running tool 250 and a junction isolation tool 260. In some aspects, the liner assembly can be a hookless hanger system.

Figure 2:
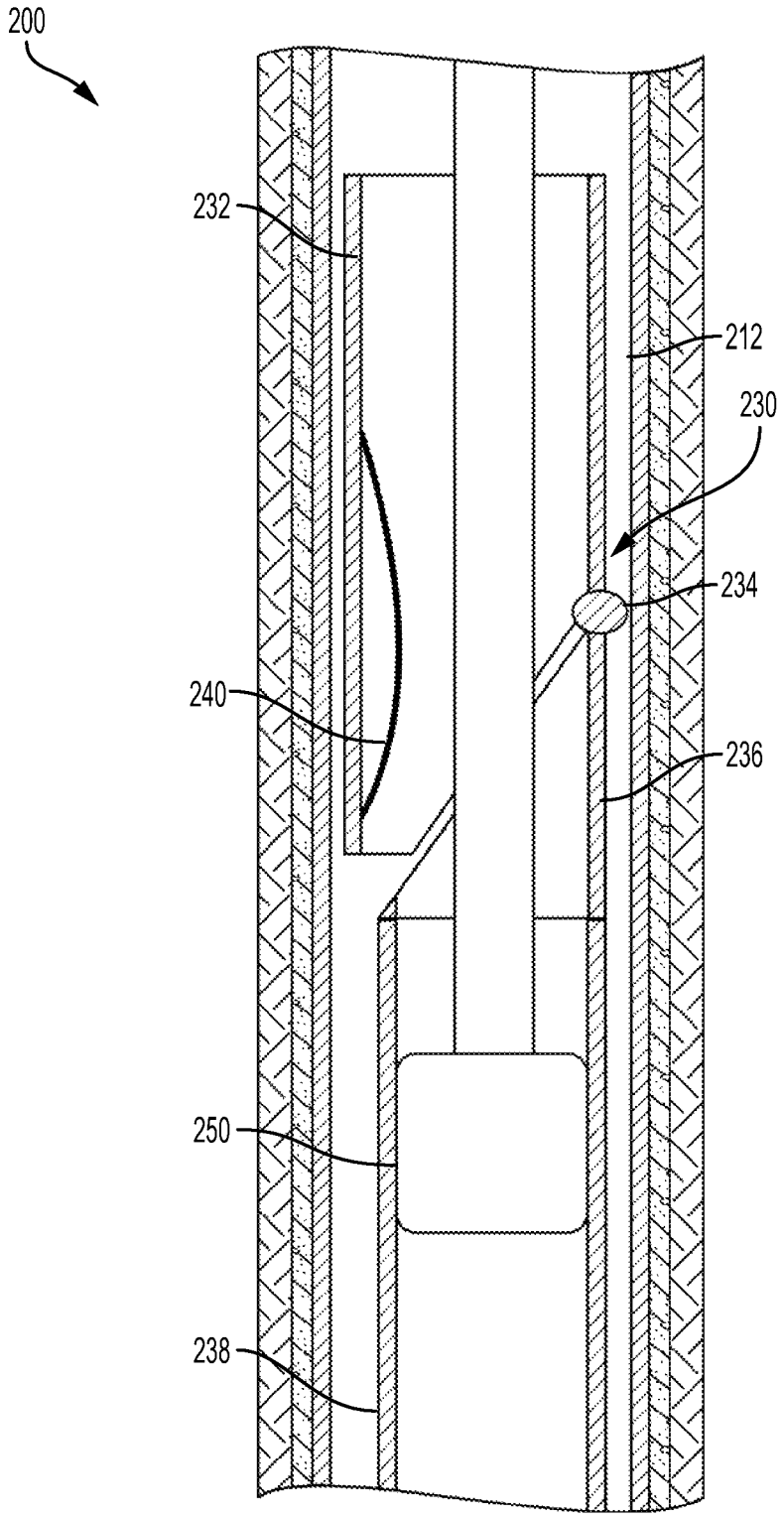
FIG. 2 is a cross-sectional diagram of a hookless hanger assembly in a main bore of a multilateral wellbore according to one aspect of the present disclosure.

FIG. 2 is a cross-sectional diagram of the well system 200 with the liner assembly 230 as being positioned in the main bore 212 by a running tool 250. A longitudinal axis of the upper tubular body 232 is substantially parallel with a longitudinal axis of the lower tubular body 236. The hinge pin 234 can couple the upper tubular body 232 to the lower tubular body 236. The running tool 250 can extend through an inner area of the liner assembly 230. The bow spring 240 can be in a retracted position for limiting interaction with other components (e.g., the running tool 250) in the inner area of the liner assembly 230. In some aspects, the bow spring 240 can be constructed from a dissolvable material.

Figure 3:
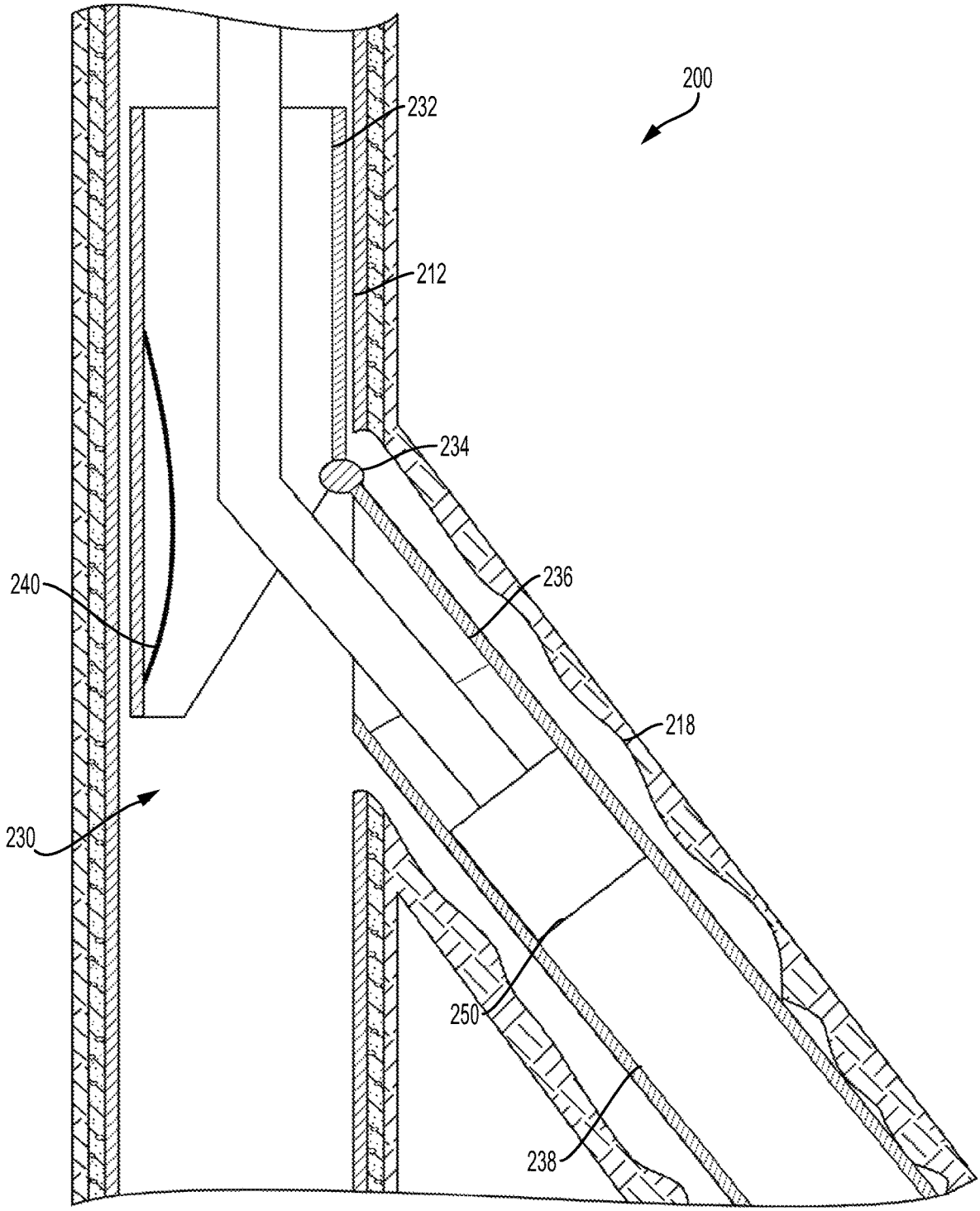
FIG. 3 is a cross-sectional diagram of the hookless hanger assembly in FIG. 2 positioned by a running tool to extend from the main bore into a lateral bore according to one aspect of the present disclosure.

FIG. 3 is a cross-sectional diagram of the well system 200 with the lower tubular body 236 positioned in the lateral bore 218 by the running tool 250. The liner string 238 couples to the lower tubular body 236 and extends from the lower tubular body 236 into the lateral bore 218. The lower tubular body 236 is pivoted about the hinge pin 234 such that the lower tubular body extends radially from an end of the upper tubular body 232 positioned in the main bore 212.

Bow spring 240 can be in a retracted position so that the running tool 250 can be removed from the liner assembly 230 without moving the liner assembly 230. The bow spring 240 can be held in the retracted position. In some aspects, exposure to a specific fluid can allow the bow spring 240 to move to an extended position. In additional or alternative aspects, removal of the running tool 250 from the liner assembly 230 can cause shearing that can allow the bow spring 240 to move to the extended position.

Figure 4:
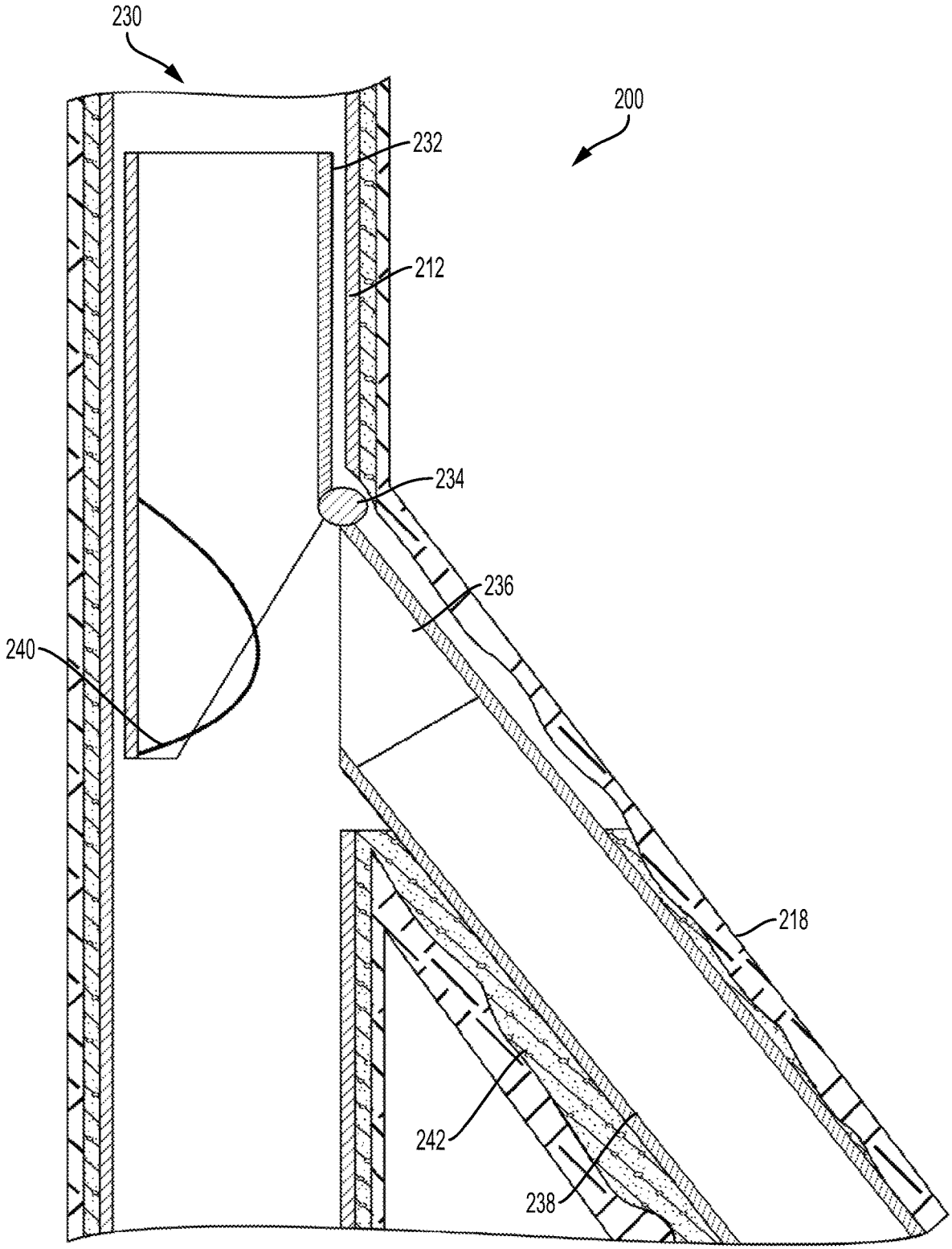
FIG. 4 is a cross-sectional diagram of the hookless hanger assembly in FIG. 2 with the running tool removed to allow for additional tools to be inserted according to one aspect of the present disclosure.

FIG. 4 is a cross-sectional diagram of the well system 200 with the running tool 250 removed from the wellbore. The upper tubular body 232 and hinge pin 234 can remain in the main bore 212 and prevent the liner assembly 230 from moving further into the wellbore. The lower tubular body 236 can be positioned in the lateral bore 218 with one end of the lower tubular body 236 flush with an opening between the main bore 212 and the lateral bore 218. The liner string 238 can be coupled to the lower tubular body 236 and extend into the lateral bore 218. A cement casing 242 can be positioned around the lower tubular body 236 and the liner string 238 to retain the lower tubular body 236 and the liner string 238 in the lateral bore 218.

In some aspects, bow spring 240 can be coupled to the upper tubular body 232 and can be in an extended position. In the extended position, the bow spring 240 can guide tools inserted into the upper tubular body 232 into the lower tubular body 236 and the lateral bore 218. For example the bow spring 240 can move between an extended position in which the bow spring 240 can guide a tool into the lateral bore 218 to a retracted position at which the tool can be moved past the bow spring 240 without deflecting the tool. In the extended position, the bow spring 240 extends farther from an inner surface of the upper tubular body 232 than in the retracted position. In some examples, bow spring 240 has a first end coupled to the upper tubular body 232 and a second end that can be slid along the inner surface of the upper tubular body 232 to move between the extended position and the retracted position.

Figure 5:
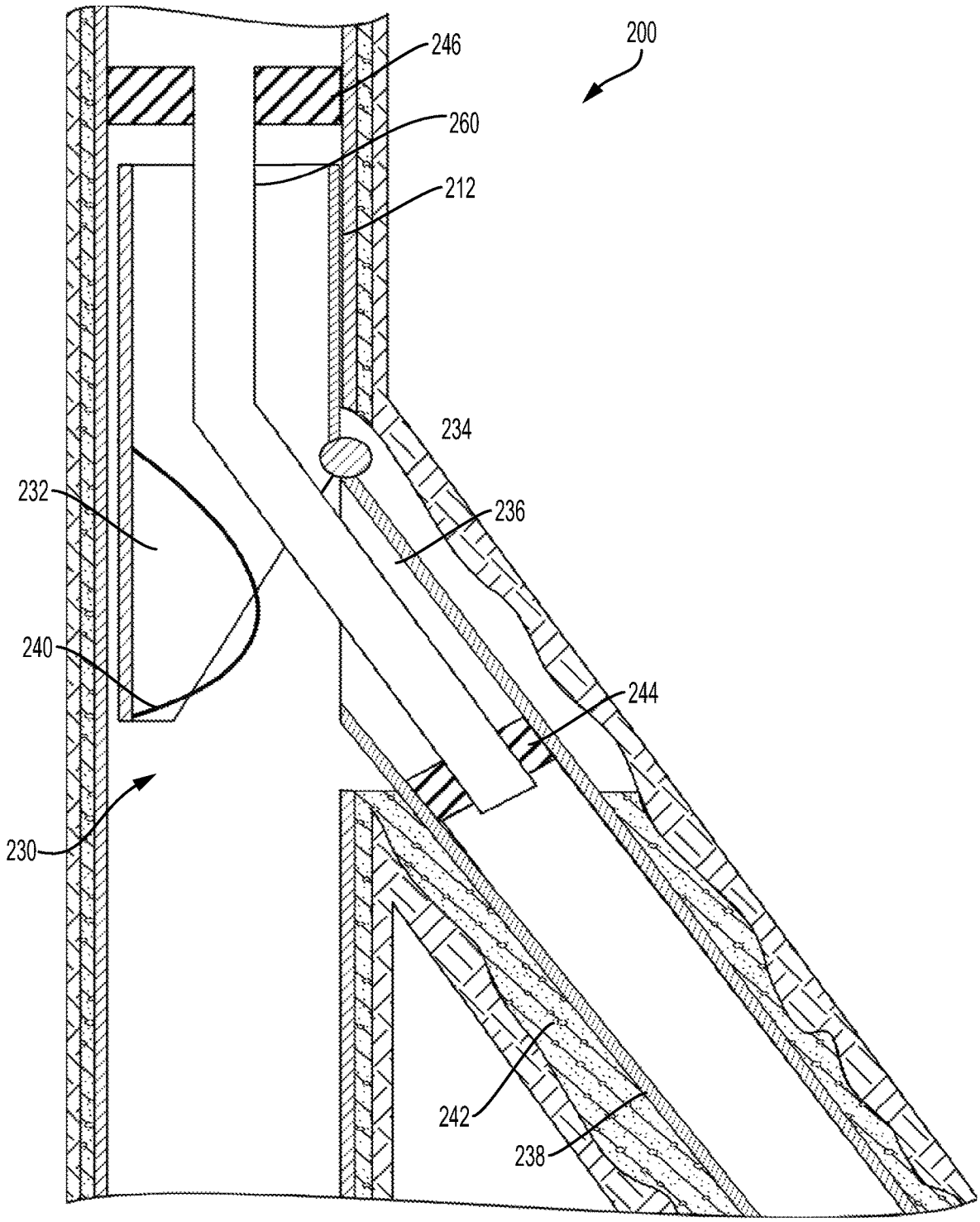
FIG. 5 is a cross-sectional diagram of the hookless hanger assembly in FIG. 2 with a junction isolation tool according to one aspect of the present disclosure.

FIG. 5 is a cross-sectional diagram of the well system 200 with the junction isolation tool ("JIT") 260 positioned in the liner assembly 230 such that the JIT 260 extends from the main bore 212 into the lateral bore 218. The lower tubular body 236 can be pivotally coupled to the upper tubular body 232 at hinge pin 234. The JIT 260 may have been inserted into the upper tubular body 232 and been guided by bow spring 240 into the lower tubular body 236. Liner string 238 can be coupled to the lower tubular body 236 and a cement casing 242 can retain the liner string 238 and the lower tubular body 236 in the lateral bore 218.

In some aspects, a fracking operation or an acidizing operation can be performed in the lateral bore 218 by pumping treatment fluid into the lateral bore 218. The JIT 260 can include a seal assembly 244 and a packer 246 for sealing a junction between the main bore 212 and the lateral bore 218 from fracking pressure. The seal assembly 244 can press into a polished bore in the liner string 238 for the junction from the fracking pressure in the lateral bore 218. The packer 246 can seal the junction from the fracking pressure in a portion of the main bore 212 that is closer to a surface of the well system 200 than the junction.

Figure 6:
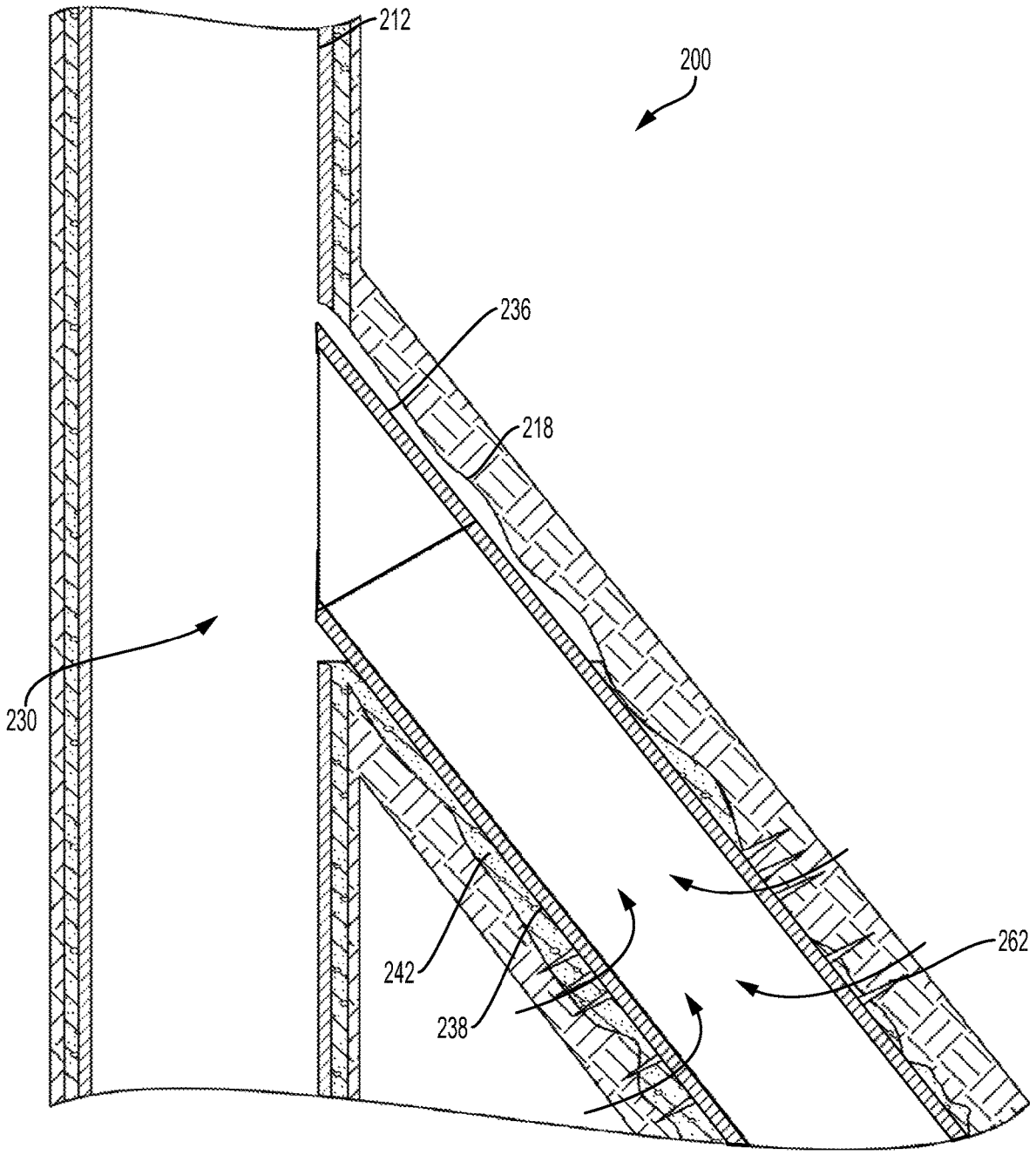
FIG. 6 is a cross-sectional diagram of the hookless hanger assembly in FIG. 2 with the top liner removed according to one aspect of the present disclosure.

FIG. 6 is a cross-sectional diagram of the well system 200 after a fracking operation in the lateral bore 218. The hinge pin 234 may have been dissolved and the upper tubular body 232 may have been dissolved or removed from the wellbore. The liner assembly 230 includes the lower tubular body 236 and the liner string 238. The lower tubular body 236 can be positioned in the lateral bore 218. The liner string 238 couples to the lower tubular body 236 and extends from the lower tubular body 236 to a stimulation zone of the lateral bore 218 with fractures 262. The fractures 262 may be created by pumping a treatment fluid into the stimulation zone using a junction isolation tool. The fractures 262 can allow production fluid to enter the liner string 238. In some aspects, the production fluid can dissolve the hinge pin 234 or the upper tubular body 232. In some aspects, the hinge pin 234 can be dissolved to cause the upper tubular body 232 to be separated from the lower tubular body 236. The upper tubular body 232 can be removed using a rig, or coiled tubing by using an internal catch tool, such as a spear.

Figure 7:
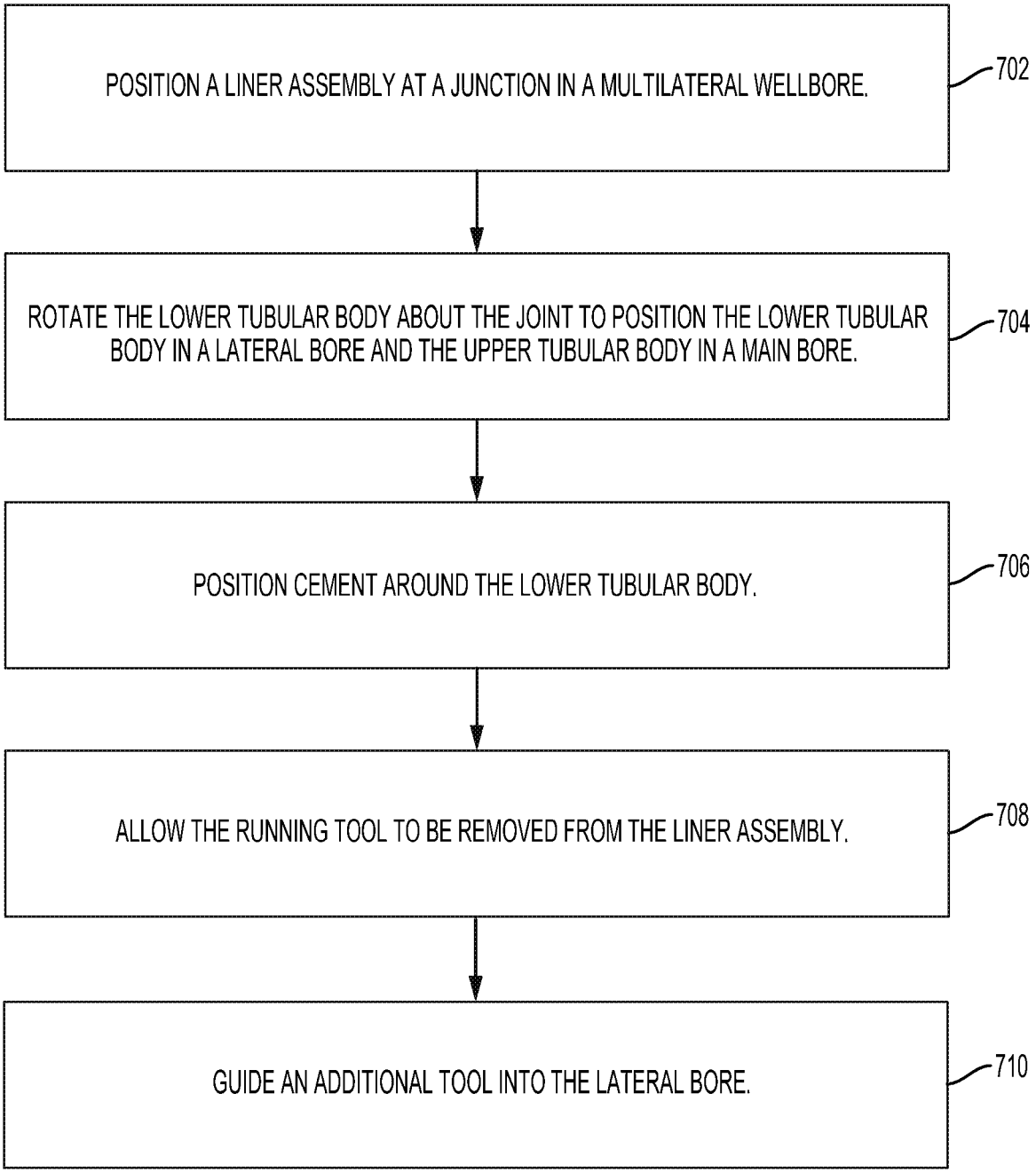
FIG. 7 is a flow chart of an example of a process for positioning a hookless hanger assembly in a multilateral wellbore according to one aspect of the present disclosure.

FIG. 7 is a flow chart of a process for positioning a hookless hanger in a multilateral wellbore. A hookless hanger can provide a multilateral junction (e.g., a TAML level 3 or level 4 multilateral junction) for a multilateral wellbore. A hookless hanger can reduce the number of runs into a wellbore and the cost of each run for accessing a lateral bore.

In block 702, the liner assembly is positioned at a junction in a multilateral wellbore. The liner assembly having a lower tubular body pivotally coupled to an upper tubular body at a joint. The liner assembly can be positioned such that the upper tubular body is radially adjacent to an opening between the main bore and the lateral bore.

In block 704, the lower tubular body is pivoted about the joint to position the lower tubular body in a lateral bore and the upper tubular body in a main bore. The lower tubular body can be shaped based on an opening between the main bore and the lateral bore. In some aspects, an end of the lower tubular body closest to the main bore is angled such that the end of the lower tubular body is flush with the opening. In block 706, cement is positioned around the lower tubular body and the liner string. The cement can retain the lower tubular body at a location in the lateral bore and form a seal between the main bore and the lateral bore. In some aspects, the lower tubular body can be retained in the lateral bore without using cement. For example, the upper tubular body and joint can form a stop, preventing the liner assembly from moving farther into the wellbore.

In block 708, the running tool is allowed to be removed from the liner assembly. In some aspects, a deflector (e.g., a bow spring or a spring-loaded ramp) can be coupled to an inner surface of the upper tubular body. In some aspects, a bow spring can be in a retracted position so that the running tool can be removed from the liner assembly without moving the liner assembly. The bow spring can be held in the retracted position and can move to an extended position in response to exposure to a specific fluid. In additional or alternative aspects, the bow spring can move to an extended device in response to shearing during removal of the running tool from the liner assembly.

In block 710, an additional tool is guided to the lateral bore. The deflector can be in the extended position to guide the additional tool from the upper tubular body to the lower tubular body and the lateral bore.

Figure 8:
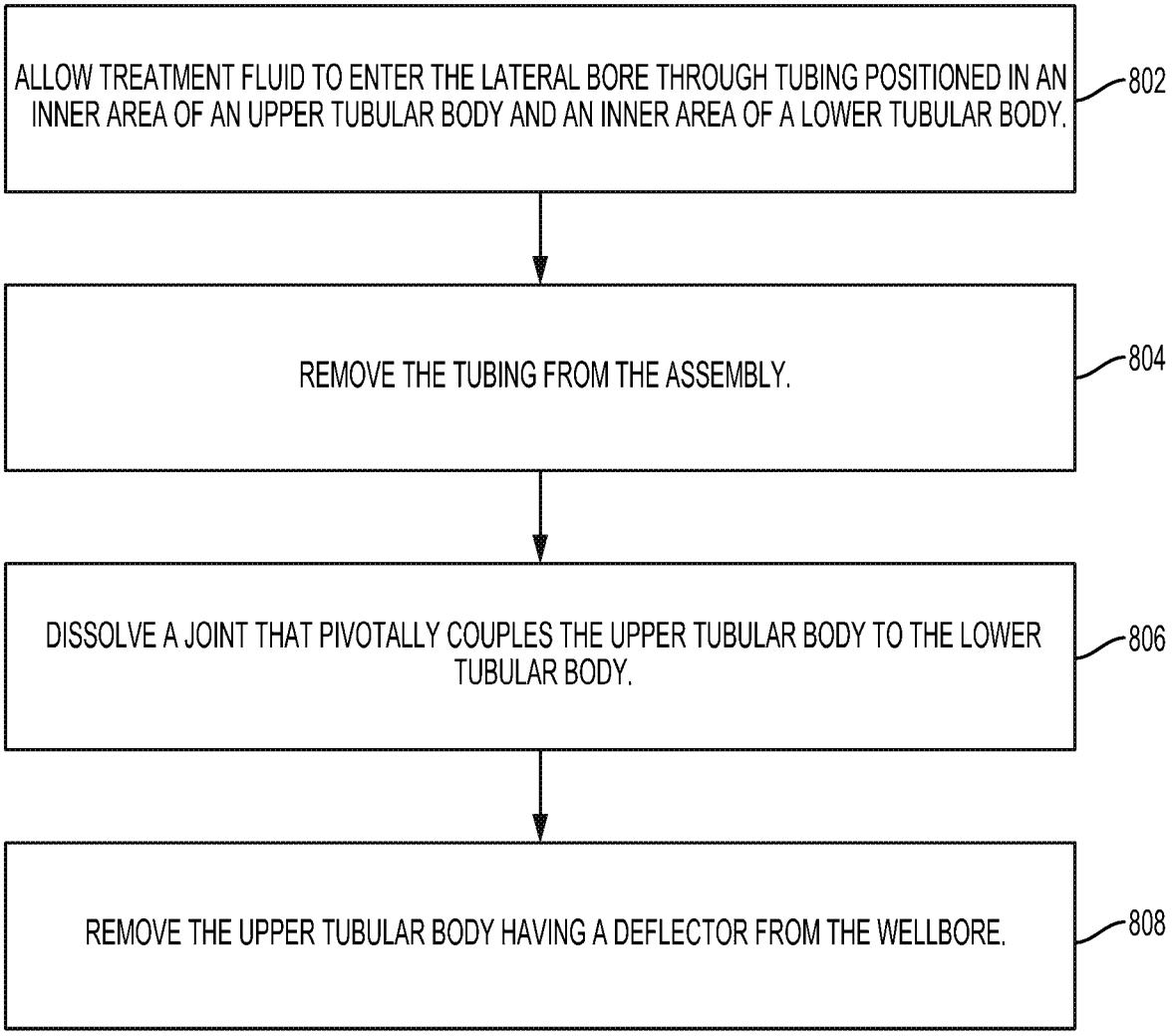
FIG. 8 is a flow chart of an example of a process for using a hookless hanger assembly in a multilateral wellbore according to one aspect of the present disclosure.

FIG. 8 is a flow chart of a process for using a hookless hanger in a multilateral wellbore. In some aspects, the main bore can be left unobstructed after an operation is performed in the lateral bore.

In block 802, treatment fluid (e.g., fracking fluid) is allowed to enter the lateral bore through tubing positioned in an inner area of an upper tubular body and an inner area of a lower tubular body. The treatment fluid can stimulate the portion of the lower tubular body creating fractures or removing blockages to improve production of well fluid. In block 804, the tubing is removed from assembly. The diverter can be flexible to allow the tubing to pass thereby through the liner assembly.

In block 806, a joint pivotally couples the upper tubular body to the lower tubular body is dissolved. In some aspects, the joint (e.g., a hinge pin) can be dissolved to separate the upper tubular body from the lower tubular body. In some aspects, the joint can dissolve in response to an acidity of the fluid, a temperature of the fluid, or a chemical composition of the fluid. The joint may dissolve in response to being exposed to well fluid from flowing through the liner assembly from the lower tubular body to the upper tubular body.

In block 808, the upper tubular body having a deflector is removed from the wellbore. The upper tubular body can be removed separate from the lower tubular body using a spear or other retrieval device coupled to drill pipe or coiled tubing. In some aspects, the upper tubular body and deflector can be dissolved.

In some aspects, a hookless hanger for a multilateral wellbore is provided according to one or more of the following examples:

Example #1

An assembly can include an upper tubular body and a lower tubular body. The upper tubular body can be positioned in a main bore of a wellbore. The lower tubular body can be pivotally coupled to the upper tubular body at a joint to allow the lower tubular body to pivot relative to the upper tubular body. The lower tubular body can be positioned in a lateral bore of the wellbore.

Example #2

The assembly of Example #1, can feature the joint dissolved such that the upper tubular body can be separated from the lower tubular body. The upper tubular body can be removed from the wellbore while the lower tubular body is positioned in the lateral bore.

Example #3

The assembly of Example #2, can feature the joint being dissolved in response to contact with fluid naturally present in the wellbore.

Example #4

The assembly of Example #2, can feature the joint being a hinge pin made of magnesium alloy. The hinge pin can be dissolved in response to contact with an acid introduced into the wellbore.

Example #5

The assembly of Example #1, can further include a deflector coupled to an inner surface of the upper tubular body. The deflector can be for guiding a tool from an inner area of the upper tubular body into the lower tubular body and the lateral bore.

Example #6

The assembly of Example #5, can feature the deflector being a bow spring that is moveable between an extended position for guiding the tool into the lateral bore and a retracted position for allowing the tool to be removed from the assembly.

Example #7

The assembly of Example #5, can feature the deflector being a spring-loaded ramp that is moveable between an extended position for guiding the tool into the lateral bore and a retracted position for allowing the tool to be removed from the assembly.

Example #8

The assembly of Example #5, can feature the upper tubular body and the deflector being dissolved.

Example #9

The assembly of Example #1, can feature the upper tubular body and the lower tubular body being positioned in the wellbore by a running tool. The running tool can extend through the upper tubular body and the lower tubular body and can be removed from the assembly.

Example #10

A system including an upper tubular body, a lower tubular body, and a running tool. The lower tubular body can be pivotally coupled to the upper tubular body at a joint to form a liner assembly and to allow the lower tubular body to pivot relative to the upper tubular body. The running tool can be positioned in the liner assembly to position the liner assembly at a junction in a wellbore between a main bore and a lateral bore. The running tool can position the upper tubular body in the main bore and the lower tubular body in the lateral bore.

Example #11

The system of Example #10, can feature the joint being dissolved to allow the upper tubular body to be separated from the lower tubular body and removed from the wellbore.

Example #12

The system of Example #10, can further include a deflector coupled to an inner surface of the upper tubular body for guiding an additional tool into the lateral bore. The upper tubular body and the deflector can be dissolved.

Example #13

The system of Example #12, can feature the deflector moving between a retracted position for allowing the running tool or the additional tool to be removed from an inner area of the liner assembly and an extended position for guiding the additional tool through the liner assembly and into the lateral bore.

Example #14

The system of Example #10, can feature the lower tubular body being fixable in the lateral bore by cement.

Example #15

A method can include positioning a liner assembly at a junction in a multilateral wellbore by a running tool. The liner assembly can have a lower tubular body pivotally coupled to an upper tubular body at a joint. The method can further include rotating the lower tubular body about the joint such that the lower tubular body is positioned in a lateral bore of the multilateral wellbore and the upper tubular body is positioned in a main bore of the multilateral wellbore. The method can further include guiding an additional tool into the lateral bore by a deflector. The deflector can be coupled to an inner area of the upper tubular body for deflecting the additional tool through the lower tubular body and into the lower tubular body after removing the running tool from the liner assembly.

Example #16

The method of Example #15, can further include dissolving the joint such that the upper tubular body is separated from the lower tubular body.

Example #17

The method of Example #16, can further include removing the upper tubular body and the deflector from the multilateral wellbore with the lower tubular body remaining in the lateral bore.

Example #18

The method of Example #15, can further include dissolving the upper tubular body and the deflector such that the liner assembly is flush with a window between the lateral bore and the main bore and the liner assembly extends from the window into the lateral bore.

Example #19

The method of Example #15, can feature the additional tool being a junction isolation tool for isolating a portion of the lateral bore from the main bore. The method can further include allowing fracking fluid to move through the liner assembly into the portion of the lateral bore for stimulating a subterranean formation.

Example #20

The method of Example #15, can feature removing the running tool as including moving the deflector from a retracted position for allowing the running tool or the additional tool to pass thereby to an extended position for guiding the additional tool into the lateral bore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

an upper tubular body positionable in a main bore of a wellbore, wherein the upper tubular body is dissolvable in the wellbore;

a lower tubular body pivotally coupleable to the upper tubular body at a joint for allowing the lower tubular body to pivot relative to the upper tubular body, the lower tubular body being positionable in a lateral bore of the wellbore; and a deflector coupleable to an inner surface of the upper tubular body for guiding a tool from an inner area of the upper tubular body into the lower tubular body and the lateral bore.

2. The assembly of claim 1, wherein the joint is dissolvable.

3. The assembly of claim 1, wherein the upper tubular body is dissolvable in response to contact with fluid naturally present in the wellbore.

4. The assembly of claim 1, wherein the upper tubular body is a made of magnesium alloy and is dissolvable in response to contact with an acid introduced into the wellbore.

5. The assembly of claim 1, wherein the deflector is a bow spring that is moveable between an extended position for guiding the tool into the lateral bore and a retracted position for allowing the tool to be removed from the assembly.

6. The assembly of claim 1, wherein the deflector is a spring-loaded ramp that is moveable between an extended position for guiding the tool into the lateral bore and a retracted position for allowing the tool to be removed from the assembly.

7. The assembly of claim 1, wherein the deflector is dissolvable.

8. The assembly of claim 1, wherein the upper tubular body and the lower tubular body are positionable in the wellbore by a running tool that extends through the upper tubular body and the lower tubular body and that is removable from the assembly.

9. A system comprising:

an upper tubular body dissolvable in a wellbore;

a lower tubular body pivotally coupleable to the upper tubular body at a joint to form a liner assembly and for allowing the lower tubular body to pivot relative to the upper tubular body;

a running tool positionable in the liner assembly for positioning the liner assembly at a junction in the wellbore between a main bore and a lateral bore and for positioning the upper tubular body in the main bore and the lower tubular body in the lateral bore; and a deflector coupleable to an inner surface of the upper tubular body for guiding an additional tool into the lateral bore.

10. The system of claim 9, wherein the joint is dissolvable.

11. The system of claim 9, wherein the deflector is moveable between a retracted position for allowing the running tool or the additional tool to be removed from an inner area of the liner assembly and an extended position for guiding the additional tool through the liner assembly and into the lateral bore.

12. The system of claim 9, wherein the lower tubular body is fixable in the lateral bore by cement.

13. A method comprising:

positioning a liner assembly at a junction in a multilateral wellbore by a running tool, the liner assembly having a lower tubular body pivotally coupled to an upper tubular body at a joint;

rotating the lower tubular body about the joint such that the lower tubular body is positioned in a lateral bore of the multilateral wellbore and the upper tubular body is positioned in a main bore of the multilateral wellbore;

guiding an additional tool into the lateral bore by a deflector coupled to an inner area of the upper tubular body for deflecting the additional tool through the upper tubular body and into the lower tubular body after removing the running tool from the liner assembly; and dissolving the upper tubular body such that the liner assembly is flush with a window between the lateral bore and the main bore and the liner assembly extends from the window into the lateral bore.

14. The method of claim 13, further comprising:

dissolving the joint.

15. The method of claim 14, further comprising:

removing the upper tubular body and the deflector from the multilateral wellbore with the lower tubular body remaining in the lateral bore.

16. The method of claim 13, further comprising:

dissolving the deflector.

17. The method of claim 13, wherein the additional tool is a junction isolation tool for isolating a portion of the lateral bore from the main bore, the method further comprising:

allowing fracking fluid to move through the liner assembly into the portion of the lateral bore for stimulating a subterranean formation.

18. The method of claim 13, wherein removing the running tool further comprises moving the deflector from a retracted position for allowing the running tool or the additional tool to pass thereby to an extended position for guiding the additional tool into the lateral bore.

* * * * *